US006534175B1

(12) United States Patent
Zhu et al.

(10) Patent No.: US 6,534,175 B1
(45) Date of Patent: Mar. 18, 2003

(54) CUT RESISTANT FABRIC

(75) Inventors: Reiyao Zhu, Midlothian, VA (US); Larry John Prickett, Chesterfield, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 221 days.

(21) Appl. No.: 09/595,314

(22) Filed: Jun. 16, 2000

(51) Int. Cl.[7] ..... D02G 3/00; D02G 3/36

(52) U.S. Cl. ..... 428/365; 57/210; 57/211; 57/218; 442/197; 442/310

(58) Field of Search ..... 442/190, 197, 442/228, 229, 308, 310, 316, 377; 428/365; 57/210, 211, 218

(56) References Cited

U.S. PATENT DOCUMENTS

| | | | | |
|---|---|---|---|---|
| 4,004,295 | A | 1/1977 | Byrnes, Sr. | 2/161 R |
| 4,225,442 | A | 9/1980 | Tremblay et al. | 210/497.1 |
| 4,384,449 | A | 5/1983 | Byrnes, Sr. et al. | 57/210 |
| 4,470,251 | A | 9/1984 | Bettcher | 57/230 |
| 4,499,716 | A | 2/1985 | Antal et al. | 57/234 |
| 4,825,470 | A | 5/1989 | Horio | |
| 5,248,548 | A | 9/1993 | Toon | 428/222 |
| 5,287,690 | A | 2/1994 | Toon | 57/210 |

FOREIGN PATENT DOCUMENTS

| | | | |
|---|---|---|---|
| EP | 0 445 872 | A | 9/1991 |

OTHER PUBLICATIONS

Dictionary of Fiber & Textile Technology. KoSa. Charlotte, NC. 199. pp. 188, 222.*

ASTM Designation: D 3884—92, Standard Test Method for Abrasion Resistance of Textile Fabrics (Rotary Platform, Double–Head Method)1, 1992, pp.160–164.

ASTM Designation: F 1790—97, Standard Test Method for Measuring Cut Resistance of Materials Used in Protective Clothing1, 1997, pp. 1–6.

* cited by examiner

*Primary Examiner*—Cheryl A. Juska
*Assistant Examiner*—Jenna-Leigh Befumo

(57) ABSTRACT

The present invention relates to a comfortable cut resistant fabric wherein metal fibers in the fabric are shielded from abrasive exposure by being wrapped with cut resistant staple fibers.

2 Claims, 1 Drawing Sheet

CUT RESISTANT FABRIC

BACKGROUND OF THE INVENTION

Field of the Invention. This invention relates to cut resistant fabric to be used in articles of protective clothing. The fabric is cut resistant by virtue of cut resistant synthetic fibers and metal fibers combined in a particular manner to afford comfort as well as protection.

Description of Related Art. U.S. Pat. Nos. 5,287,690; 5,248,548; 4,470,251; 4,384,449; and 4,004,295, all disclose the use of yarns having metallic fiber cores and high strength synthetic fiber wrappings to make fabrics used in cut resistant articles of clothing.

BRIEF SUMMARY OF THE INVENTION

This invention relates to a cut resistant fabric made with at least one bundle of at least one yarn wherein the yarn comprises at least two strands: at least one of the strands in the bundle having a sheath/core construction with a sheath of cut resistant staple fibers and a metal fiber core; and at least one of the strands in the bundle having cut resistant aramid fibers and being free from metal fibers.

DETAILED DESCRIPTION OF THE INVENTION

Cut resistant fabrics are very important for protection in coverings and apparel and the like. Cut resistant gloves, for example, have been the subject of intensive developmental work for many years. Along with cut resistance, it is often important or desirable that fabrics exhibit high durability and flexibility; and that they have a comfortable hand. The fabric of this invention is highly cut resistant, durable, and flexible; and has a softness that results in very comfortable and effective protective apparel.

One source of cut resistance in the fabric of this invention is aramid fibers. The fabric also contains metal fibers that add to the cut resist capabilities. Fabrics made exclusively of metal fibers are stiff and difficult to handle and yield heavy, uncomfortable, and abrasive cut resistant apparel. However, metal fibers, combined with aramid fibers in the manner of this invention, can be used to make cut resistant fabric for protective apparel; and the fabric is comfortable and non-abrasive as well as cut resistant. It has been found that a very small amount of metal fiber can increase cut resistance of the fabric to a surprising degree.

Figure 1:
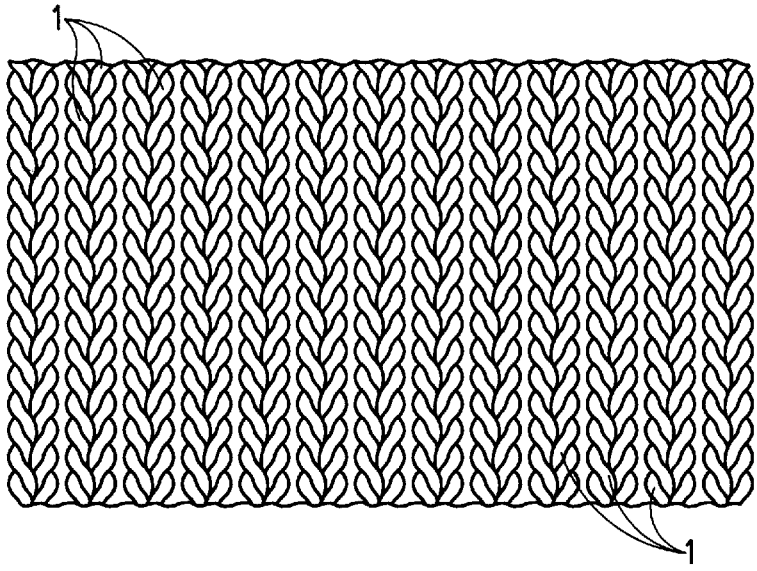
FIG. 1 is a representation of a fabric of this invention.

Referring to the Figures, FIG. 1 is a representation of a fabric of this invention with bundles 1 of yarns shown in the fabric pattern. The bundles 1 may be the same or different. If the fabric is knitted, any appropriate knit pattern is acceptable. Cut resistance and comfort are affected by tightness of the knit and that tightness can be adjusted to meet any specific need. A very effective combination of cut resistance and comfort has been found in for example, single jersey and terry knit patterns.

Figure 2:
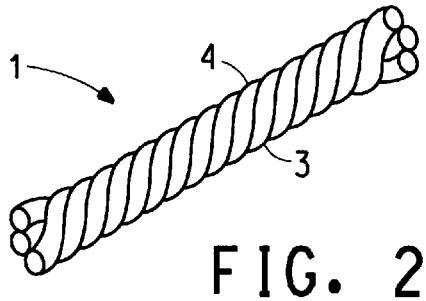
FIG. 2 is a representation of a bundle in a fabric of this invention.

FIG. 2 is a representation of a bundle 1 including yarns 3 and 4 for use in the fabric of this invention. Bundle 1 includes at least one yarn and may have as many as six yarns, or more. Three yarns are generally preferred. The yarns in bundle 1 are usually twisted but twisting is not necessary.

Yarn 3, as an example of a yarn in bundle 1, can be made solely from aramid fibers and the fibers can be continuous filaments or they can be spun staple. Yarn 3 can, of course, include some fibers of other materials, such as cotton or nylon or the like, but it must be recognized that the cut resistance of the yarn may be diminished by the presence of such other materials. Yarn 3, whether made from continuous filaments or staple fibers, has a linear density of 300 to 2000 dtex, and the individual filaments or fibers have a linear density of 0.5 to 7 dtex, preferably 1.5 to 3 dtex. Yarn 3 is made up of at least two strands.

Yarn 4, as an example of a yarn in bundle 1, can be made to include at least one metal fiber core. In addition to the metal fiber core, yarn 4 can have a sheath of aramid fibers, either as continuous filaments or as spun staple. The sheath of yarn 4 can, also, include some fibers of other materials to the extent that decreased cut resistance, due to that other material, can be tolerated. Yarn 4 is made up of at least two strands.

Figure 3:
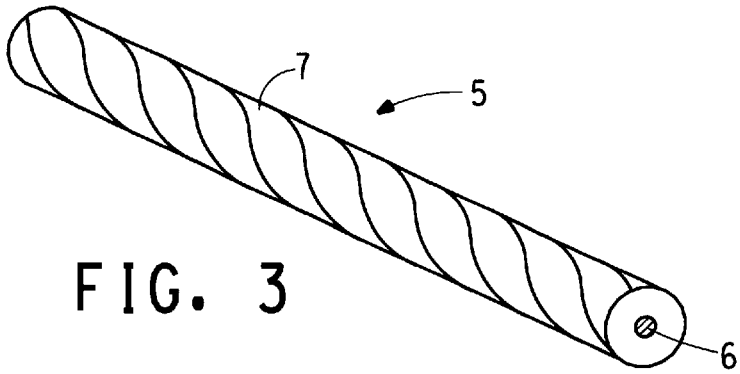
FIG. 3 is a representation of a yarn in a bundle in a fabric of this invention having a sheath/core construction with a sheath of cut resistant staple fibers and a metal fiber core.

FIG. 3 is a representation of a strand from yarn 4 (FIG. 2). Strand 5 has so-called sheath/core construction that involves metal fiber core 6 and aramid fiber sheath 7. Metal fiber core 6 can be a single metal fiber or several metal fibers, as needed or desired for a particular situation. Aramid fiber sheath 7 can be served, wrapped, or spun around metal fiber core 6. If served, the aramid fibers are generally in the form of continuous filaments a plurality of which are applied in one or more layers around metal fiber core 6 at an angle nearly perpendicular with the axis of the core to cover the core. If wrapped, the,aramid fibers are generally in the form of staple fibers loosely spun by known means, such as, ring spinning, wrap spinning, air-jet spinning, open-end spinning, and the like; and then wound around the core at a density sufficient to substantially cover the core. If spun, the aramid fibers are staple fibers formed directly over metal fiber core 6 by any appropriate sheath/core-spinning process such as DREF spinning or so-called Murata jet spinning or another core spinning process.

Strands with a metal fiber core, such as strand 5, are generally 1 to 50 weight percent metal with a total linear density of 100 to 5000 dtex. Strands without metal fiber core, such as in yarn 3, generally have a linear density of 100 to 5000 dtex. Aramid fibers present in the strands, whether as continuous filaments or staple, have a diameter of 5 to 25 micrometers and a linear density of 0.5 to 7 dtex. Staple aramid fibers may be 2 to 20 centimeters, preferably 4 to 6 centimeters, long.

Bundles used in the fabric of this invention must include at least one strand of aramid fibers free of metal fibers and at least one strand that has a sheath/core construction with an aramid fiber sheath and a metal fiber core.

The aramid fibers of this invention are generally para-aramid fibers. By para-aramid fibers is meant fibers made from para-aramid polymers; and poly(p-phenylene terephthalamide)(PPD-T) is the preferred para-aramid polymer. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichloroterephthaloyl chloride; provided, only that the other aromatic diamines and aromatic diacid chlorides be present in amounts which do not adversely affect the properties of the para-aramid.

Additives can be used with the para-aramid in the fibers and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid.

P-aramid fibers are generally spun by extrusion of a solution of the p-aramid through a capillary into a coagulating bath. In the case of poly(p-phenylene terephthalamide), the solvent for the solution is generally concentrated sulfuric acid, the extrusion is generally through an air gap into a cold, aqueots, coagulating bath. Such processes are well-known and do not form a part of the present invention.

By metal fibers is meant fibers or wire made from a ductile metal such as stainless steel, copper, aluminum, bronze, and the like. Stainless steel is the preferred metal. The metal fibers are generally continuous wires. The metal fibers are 10 to 150 micrometers in diameter, and are preferably 25 to 75 micrometers in diameter.

The strands, whether including a metal fiber core or not, may have some twist. The yarns, also, will have some twist and the twist in-the yarn is generally opposite the twist in the strands. Generally, there is no twist in the bundles. In any of strands or yarns, twist is generally 2 to 10 turns per centimeter.

The fabric of this invention provides a balance between cut resistance and comfort. Aramid fibers provide the primary cut resistance for the fabric of this invention, however, the overall cut resistance and the improvement in cut resistance is a result of the combination of metal fiber and aramid fiber. To increase cut resistance, additional metal fiber can be introduced into the fabric. One surprising aspect of the combination of metal and aramid fibers in this invention relates to the increase in cut resistance that is obtained by addition of only one or two strands having metal cores in all of the strands in a bundle used to make a fabric. Fabrics having at least one and less than four strands of aramid fiber sheath/metal fiber core construction in a bundle six strands, total, exhibit a particularly effective combination of cut resistance and comfort.

Aramid fibers provide comfort for the fabric of this invention; and, from a comfort point-of-view, spun staple aramid fibers are preferred. Aramid fibers are used in the fabric of this invention to cover and shield the metal fibers from contact with outside agencies. Metal fibers are distributed in the fabric by being in limited concentration in bundles of the fabric; and metal fibers are prevented from direct abrasive contact with other materials by being covered with aramid fibers in a strand, in a bundle, in a yarn.

It has been found that fabric flexibility is best maintained when the metal fibers are distributed in at least one but not all of the strands in each bundle of yarns that are used in construction of the fabric. Moreover, strands having the aramid fiber sheath/metal fiber core construction, when included in a yarn construction that is a part of a bundle construction used to make the fabric, effectively prevent exposure of the metal fibers. Metal fibers in the bundles of such a fabric construction are not exposed to scratch outside surfaces.

TEST METHODS

Cut Resistance. The method used is the "Standard Test Method for Measuring Cut Resistance of Materials Used in Protective Clothing", ASTM Standard F 1790-97. In performance of the test, a cutting edge, under specified force, is drawn one time across a sample mounted on a mandrel. At several different forces, the distance drawn from initial contact to cut through is recorded and a graph is constructed of force as a function of distance to cut through. From the graph, the force is determined for cut through at a distance of 25 millimeters and is normalized to validate the consistency of the blade supply. The normalized force is reported as the cut resistance force.

The cutting edge is a stainless steel knife blade having a sharp edge 70 millimeters long. The blade supply is calibrated by using a load of 400 g on a neoprene calibration material at the beginning and end of the test. A new cutting edge is used for each cut test.

The sample is a rectangular piece of fabric cut 50×100 millimeters on the bias at 45 degrees from the warp and fill directions.

The mandrel is a rounded electroconductive bar with a radius of 38 millimeters and the sample is mounted thereto using double-face tape. The cutting edge is drawn across the fabric on the mandrel at a right angle with the longitudinal axis of the mandrel. Cut through is recorded when the cutting edge makes electrical contact with the mandrel.

Comfort. Comfort testing is necessarily very subjective. In tests for comfort associated with this invention, 50×50 centimeter samples of all of the fabrics to be tested were placed in a random manner on a table. Test handlers were asked to manipulate each of the samples and divide them into five groupings with comfort ratings from 1 to 5, wherein 5 was the most comfortable. Ten test handlers rated all of the fabric samples and the ratings were averaged and are reported in the Table below.

EXAMPLES

Fabrics were knitted using a variety of sheath/core yarns wherein the cores were stainless steel monofilaments having a variety of diameters.

The aramid compositions were poly(p-phenylene terephthalamide) fibers about 3.8 centimeters long and 1.6 dtex per filament sold by E. I. du Pont de Nemours and Company under the tradename Kevlar® staple aramid fiber, Type 970.

The aramid fibers were fed through a standard carding machine used in the processing of short staple ring spun yarns to make carded sliver. The carded sliver was processed using two pass drawing (breaker/finisher drawing) into drawn sliver and processed on a roving frame to make a one hank roving. The roving was then divided in four;—one-fourth to be used with each of four steel cores.

Sheath-core strands were produced by ring-spinning two ends of the roving and inserting the steel core just prior to twisting. The roving was about 5900 dtex (1 hank count). In these examples, the steel cores were centered between the two drawn roving ends just prior to the final draft rollers. 10/1s cc strands were produced sing a 3.25 twist multiplier for each item.

Four stainless steel cores were used:

1. 35 micrometer steel monofilament;

2. 50 micrometer steel monofilament;

3. 75 micrometer steel monofilament;

and a strand was made using all aramid fiber with no core.

Three different yarns were made using each of the above-described metal core strands and the all aramid strands. For each steel core, the following yarns were made:

Yarn A. Two 590 dtex strands of 1.6 dtex per filament aramid fibers plied together with reverse twist where one strand has a steel core and the other has none.

Yarn B. Two 590 dtex strands of 1.6 dtex per filament aramid fibers plied together with reverse twist where both strands have a steel core.

Yarn C. Two 590 dtex strands of 1.6 dtex per filament aramid fibers plied together with reverse twist where neither strand has a steel core.

The 10/2s yarns were knitted into samples using a standard Sheima Seiki glove knitting machine. The machine knitting time was adjusted to produce glove bodies about one meter long—to provide fabric samples for subsequent cut and abrasion testing.

Samples were made by feeding 3 ends of 10/2s to the glove knitting machine to yield fabric samples of about 0.67 $kg/m^2$.

Fabric samples, with yarn content and test results are shown in the Table below.

TABLE

| wire core | | % Steel | Cut Resistance | Comfort Rating |
|---|---|---|---|---|
| 35 micron | | | | |
| 1 of 6 | Yarn A Yarn C Yarn C | 2 | 1969 | 4.9 |
| 3 of 6 | Yarn A Yarn B Yarn C | 6 | 3182 | 4.5 |
| 5 of 6 | Yarn A Yarn B Yarn B | 10 | 3955 | 3.7 |
| 50 micron | | | | |
| 1 of 6 | Yarn A Yarn C Yarn C | 4 | 3202 | 4.2 |
| 3 of 6 | Yarn A Yarn B Yarn C | 13 | 6208 | 3.2 |
| 5 of 6 | Yarn A Yarn B Yarn B | 21 | 6844 | 2.2 |
| 75 micron | | | | |
| 1 of 6 | Yarn A Yarn C Yarn C | 8 | 5250 | 2.9 |
| 3 of 6 | Yarn A Yarn B Yarn C | 25 | 6593 | 1.3 |
| 5 of 6 | Yarn A Yarn B Yarn B | 41 | 7894 | 1 |

What is claimed is:

1. A cut resistant fabric made from at least one cut resistant yarn (I) comprising a strand (a) which is a sheath/core yarn having a sheath of cut resistant staple fibers and a metal fiber core plied with a strand (b) which is a yam comprising cut resistant fibers free of metal fibers.

2. A fabric made from a bundle of cut resistant yarns wherein a strand (a) comprising a sheath/core yarn having a sheath of cut resistant staple fibers and a metal fiber core, a strand (b) made of a yarn comprising cut resistant fibers free of metal fibers, wherein cut resistant yarn (I) comprises strand (a) plied with strand (b), cut resistant yarn (II) comprises strand (a) plied with strand (a), and cut resistant yarn (III) comprises strand (b) plied with strand (b), said bundle having three cut resistant yarns wherein at least one of the cut resistant yarns is cut resistant yarn (I) and the other two cut resistant yarns can be any of cut resistant yarns (I), (II), or (III).

* * * * *